United States Patent [19]

Tawil

[11] 4,366,886

[45] * Jan. 4, 1983

[54] ATTACHE CASE INCLUDING EXPANSION GUSSET

[75] Inventor: Abraham I. Tawil, Brooklyn, N.Y.

[73] Assignee: H.I.T. Industries, Ltd., Avenel, N.J.

[ * ] Notice: The portion of the term of this patent subsequent to Nov. 2, 1999, has been disclaimed.

[21] Appl. No.: 213,418

[22] Filed: Dec. 5, 1980

[51] Int. Cl.[3] ..... A45C 7/00; A45C 13/00

[52] U.S. Cl. ..... 190/44; 150/1.7

[58] Field of Search ..... 190/44, 45, 21, 22, 190/14, 41 R; 150/1.6, 30, 1.7; 220/4 R, 7, 8; 229/DIG. 3

[56] References Cited

U.S. PATENT DOCUMENTS

| | | | |
|---|---|---|---|
| 1,341,099 | 5/1920 | Abramson | 190/44 |
| 1,672,322 | 6/1928 | Keiser et al. | 150/1 |
| 2,002,878 | 5/1935 | Belber | 190/44 |
| 3,321,053 | 5/1967 | Doppelt | 190/45 |

*Primary Examiner*—William Price
*Assistant Examiner*—Sue A. Weaver
*Attorney, Agent, or Firm*—Weinstein & Sutton

[57] ABSTRACT

The invention provides an attache case having an expansion gusset and improved fastening arrangements for opening and closing the expansion gusset. These include elastic straps with either releasable snap fasteners or fixed fasteners.

1 Claim, 6 Drawing Figures

ATTACHE CASE INCLUDING EXPANSION GUSSET

BACKGROUND OF THE INVENTION

The invention relates to attache cases and, more particularly, to an attache case including an expansion gusset for expanding the capacity of the attache case when needed.

Typically, such attache cases include first and second relatively movable sections or compartments, with at least one of the sections including an expansion gusset for expanding the capacity of the attache case. As is well known, the expansion gusset is movable between a closed position and an expanded position, and to move the expansion gusset to its expanded position, it can be done manually, or by squeezing enough contents into the attache case so that it is forced to automatically expand to its expanded position.

Referring to FIG. 1, there is shown a typical prior art arrangement of an attache case including fastening means for releasably maintaining the expansion gusset in its closed position. As will be noted, the attache case 10 includes first and second sections 12, 14 relatively movable with respect to each other for opening and closing the case. The expansion gusset 16 is shown located in movable section 14 and includes a vinyl strip 16*a* facing the exterior of the case and is covered on the interior of the case by liner 14*a*. The gusset 16 is held in its closed position by fastening means 18. Usually there are four such fastening means 18 disposed on the sidewalls 14*a* of the case. Such prior art fastening means 18 typically include a strap 20 having fixed fastening means 22 at one end thereof on one side of the expansion gusset 16, and releasable fastening means 24 on the other end of the strap 20 on the other side of the expansion gusset 16. As shown in exploded form, fixed fastening means 22 includes plate 22*a* and screws 22*b*. In operation, when it is desired to increase the capacity of the attache case, snap fasteners 24 are released, and the expansion gusset 16 is moved to its expanded position. Manual release of the snap fasteners 24 is usually satisfactory and does not damage the attache case.

However, when a force is applied to the fastening means 18 to automatically release the fastening means and to move the expansion gusset 16 to its expanded position, problems are created. More particularly, when the attache case becomes overstuffed, so that the expansion gusset 16 must move into its expanded position, a force is applied to fastening means 18 in the vertical direction of the strap 20, and such vertically-acting force will eventually cause the snap fasteners 24 to be released. However, it should be understood that a great deal of force is required in the direction of the strap 20 to release the snap fasteners 24, since the direction of force necessary to release the snap fasteners 24 is in a direction perpendicular to the sidewall 14*a* of the attache case. Accordingly, an undue vertically-directed force is applied along the strap 20 until it finally develops a sufficient component of force in the axial direction of the snap fasteners 24 to release the snap fasteners. However, it should be clear that until the snap fasteners 24 are finally released, a great deal of force is applied to the fixed fasteners 22. It has been experienced that over a period of continued use, the fixed fasteners 22 continually weaken as a result of the large force being applied thereto until the snap fasteners 24 are released. As a result, in many cases, the strap 20 eventually rips off the fixed fastener 22.

Broadly, it is an object of the present invention to provide an improved arrangement for releasing the expansion gusset into its expanded position which overcomes one or more of the aforesaid drawbacks. Specifically, it is within the contemplation of the present invention to provide an improved fastening device which is inexpensive, easy to employ, and which is not subject to undue forces and stresses to weaken the fastening device.

SUMMARY OF THE INVENTION

Briefly, in accordance with the principles of the present invention, there is provided an improved fastening arrangement for the expansion gusset of an attache case. More particularly, the attache case includes first and second sections or compartments relatively movable with respect to each other for opening and closing the attache case. At least one of the first and second sections includes an expansion gusset for expanding the capacity of the attache case, with the expansion gusset being movable between a closed position and an expanded position. In one embodiment, elastic fastening means are provided for releasably maintaining the expansion gusset in the closed position, with the elastic fastening means including elastic straps each having a first snap fastener on a first side of the expansion gusset and a second snap fastener on the other side of the expansion gusset, so that at least one of the snap fasteners may be released when the expansion gusset moves to its expanded position.

In a still further embodiment, the elastic strap of the fastening means includes fixed fasteners or rivets instead of snap fasteners.

In all embodiments, the elastic straps are able to expand an amount at least equal to the expansion distance of the expansion gusset.

Advantageously, as a result of the present invention, the problems of the prior art are avoided, since the elastic straps prevent an undue amount of force being applied to the fasteners which will eventually weaken and render useless the fastening means. In the present invention, with the elastic straps, either releasable or fixed fasteners are provided, and there is no undue force applied to the fastening means to release them.

BRIEF DESCRIPTION OF THE DRAWINGS

Further objects, features, and advantages of the present invention will become apparent upon consideration of the detailed description of the presently-preferred embodiments, when taken in conjunction with the accompanying drawings, wherein.

DETAILED DESCRIPTION OF THE PREFERRED EMBODIMENTS

Figure 1:
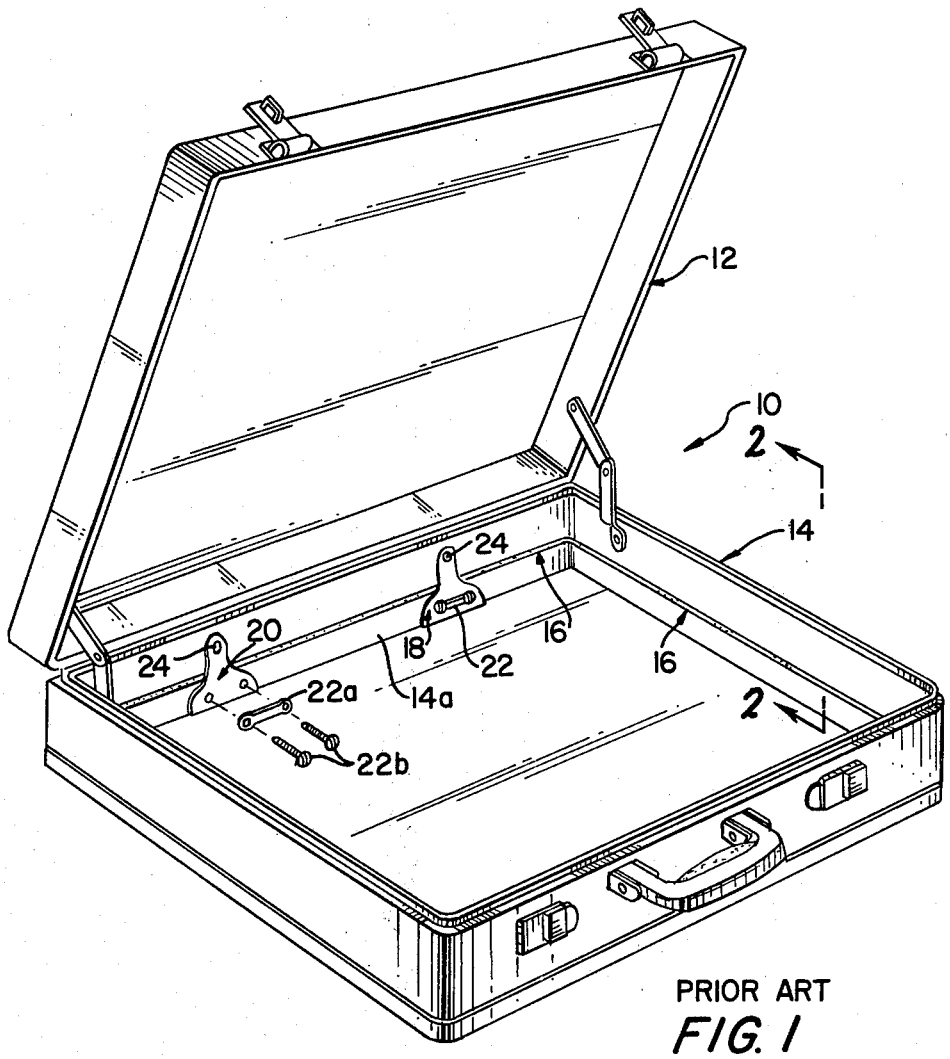
PRIOR ART FIG. 1
FIG. 1 is a perspective view of a prior art attache case including an expansion gusset.
Figure 2:
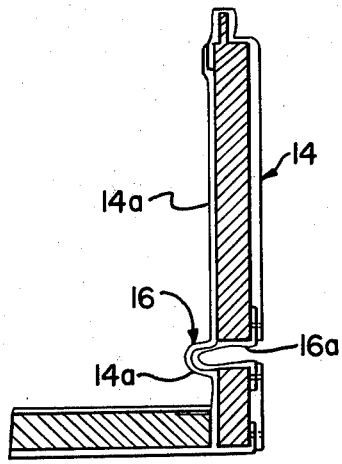
FIG. 2 is a cross section of the case shown in FIG. 1.
Figure 3:
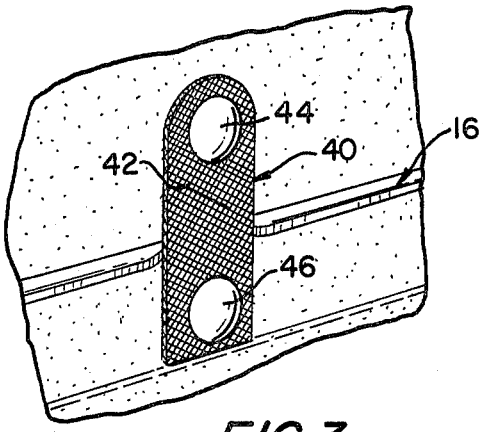
FIG. 3 illustrates the first embodiment of the present invention in which the elastic fastening means includes elastic straps and releasable snap fasteners.

Referring to FIG. 3, the first embodiment of the present invention is clearly illustrated. The improved fastening means 40 includes an elastic strap 42 and releasable snap fasteners 44, 46. In this manner, when a force is applied to open the expansion gusset 16, the elastic strap 42 expands, and either one or both of the snap fasteners 44, 46 may be released. In addition, as the strap is elastic and both fasteners are releasable, no damage can be caused to the fastening means over a period of time by having undue forces applied thereto, as shown with the prior art example illustrated in FIG. 1.

Figure 4:
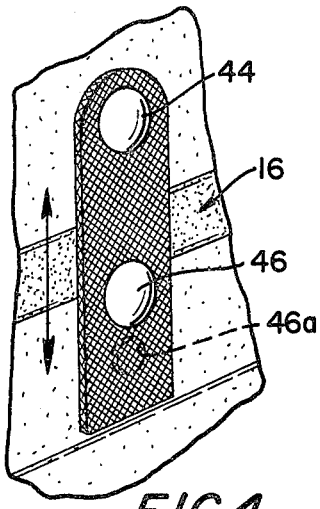
FIG. 4 shows the embodiment of FIG. 3 with the expansion gusset and elastic straps in their expanded positions.

The operation of this embodiment is clearly illustrated in FIG. 4. As shown therein, when a force is applied to open the expansion gusset 16, elastic strap 42 expands, and the lower snap fastener 46 will usually release first from snap 46*a*. In some cases, the upper snap fastener 44 may also be released. Although fasteners 44, 46 are shown as snap fasteners, other types of releasable fasteners may be employed, such as Velcro fasteners and the like.

Figure 5:
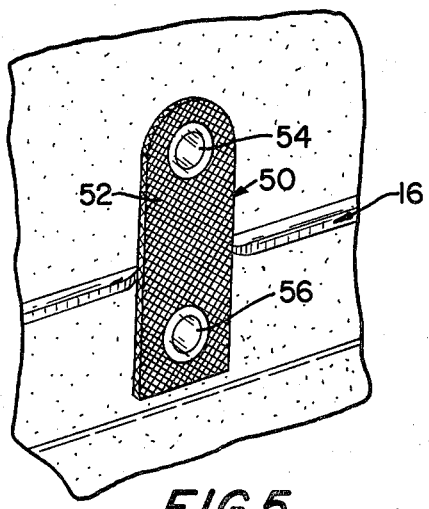
FIG. 5 is a second embodiment of the present invention wherein the elastic fastening means includes elastic straps and fixed fasteners.

Referring to FIG. 5, there is shown another embodiment of the present invention, designated as elastic fastening means 50. As shown therein, fastening means 50 includes an elastic strap 52, an upper fixed fastener 54, and a lower fixed fastener 56. Fasteners 54, 56 are shown as being rivets for attachment of the elastic straps to the case, but it should be understood that any type of fixed fastener would be suitable for this purpose. For example, the ends of the elastic straps may be sewn to the liner of the case.

Figure 6:
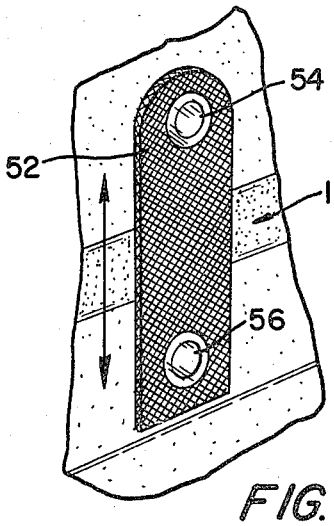
FIG. 6 illustrates the embodiment of FIG. 5 with the expansion gusset and elastic straps in their expanded positions.

As shown in FIG. 6, in this embodiment, elastic straps 52 have an elasticity at least equal to or greater than the distance which the expansion gusset 16 expands. In this manner, the elastic straps can expand, instead of applying an undue force to weaken the fixed fasteners 54, 56.

In the embodiments described above, it should be understood that four elastic straps are employed, two on each side of the case, similar to the locations of straps in conventional arrangements. However, the number of straps can be varied if desired.

Advantageously, as a result of the present invention, there has been provided an improved fastening arrangement for the expansion gussets of attache cases which avoids the problems of the prior art in which the fixed end of the fastening means becomes damaged as a result of undue forces applied thereto. As a result of the present invention, an arrangement has been provided which prevents such undue forces from being built up in the fastening means.

A latitude of modification, change, and substitution is intended in the foregoing disclosure, and in some instances, some features of the invention will be employed without a corresponding use of other features. For example, instead of employing snap fasteners, Velcro hooks and loops can be employed. Accordingly, it is appropriate that the appended claims be construed broadly and in a manner consistent with the spirit and scope of the invention herein.

What is claimed is:

1. An attache case, comprising:

first and second sections relatively movable with respect to each other for opening and closing said case;

at least one of said first and second sections including expansion means for expanding the capacity of said case, said expansion means being movable between a closed position and an expanded position;

a plurality of fastening means disposed about said case for releasably maintaining said expanding means in said closed position, each of said fastening means including a strap and a first releasable fastener on a first side of said expansion means and a second releasable fastener on a second side of said expansion means so that at least one of said first and second fasteners of each of said fastening means is released when said expansion means moves to said expanded position; and at least a portion of each of said straps between said first and second fasteners being elastic and being operative to expand when said expansion means is moved to said expanded position.

* * * * *